United States Patent [19]

Flanders

[11] 4,297,671

[45] Oct. 27, 1981

[54] TANDEM INSERT MOLDED ELECTRICAL CONTROLS AND PROCESS FOR PRODUCING SAME

[75] Inventor: Thomas W. Flanders, Edwardsburg, Mich.

[73] Assignee: CTS Corporation, Elkhart, Ind.

[21] Appl. No.: 158,597

[22] Filed: Jun. 11, 1980

[51] Int. Cl.[3] ..... H01C 10/50

[52] U.S. Cl. ..... 338/200; 338/128; 338/134; 338/184; 338/199

[58] Field of Search ..... 338/128–130, 338/132, 134, 191, 198, 200, 164, 188, 184, 199, 172, 174, 178, 179, 215; 307/112; 323/74, 94 R, 353, 369; 200/11 R, 11 DA

[56] References Cited

U.S. PATENT DOCUMENTS

| | | | |
|---|---|---|---|
| 2,632,830 | 3/1953 | Aust et al. | 338/174 |
| 2,650,270 | 8/1953 | Mucher | 338/172 |
| 2,958,838 | 11/1960 | Puerner et al. | 338/172 |
| 3,668,338 | 6/1972 | O'Malley | 200/11A |
| 3,697,921 | 10/1972 | Urwin | 338/198 |
| 3,736,390 | 5/1973 | Lockard | 200/11 DA |
| 3,760,321 | 9/1973 | Fabricius et al. | 338/134 |
| 3,924,220 | 12/1975 | Matsui et al. | 338/172 |
| 3,988,711 | 10/1976 | Van Benthuysen et al. | 338/134 |
| 4,109,230 | 8/1978 | Frey, Jr. | 338/164 |
| 4,133,990 | 1/1979 | Wanner et al. | 200/6 B |
| 4,166,200 | 8/1979 | Reichen et al. | 200/11 R |
| 4,173,006 | 10/1979 | Stuckey et al. | 338/184 |

*Primary Examiner*—C. L. Albritton

*Attorney, Agent, or Firm*—Larry J. Palguta; John A. Young

[57] ABSTRACT

A process utilizing tandem insert molded controls for effecting a plurality of electrical control functions. A power switch, variable resistance control, and momentary switch are each contained within insert molded housings or bases which are mounted one against the other in a linearly aligned relationship. The alignment is maintained by an impact system consisting of a metallic front plate having side straps with end fingers curled over to secure the confronting edges of a heat-treated back plate, the front plate/side straps/back plate construction capturing and maintaining alignment of the controls for mounting on a panel board. A plurality of the controls are individually operated by two relatively rotatably and relatively axially movable shafts which independently actuate the respective controls. The shafts each have an annular rotor mounted on an end thereof, the rotor containing a cam lobe on one face and on the oppositely disposed face resiliently bent collector arms and a resilient arm. Rotation of each shaft effects actuation of the associated power switch and rotary movement of the collector arms and the resilient arms which wipably engage a collector and a resistance element, respectively, of the associated variable resistance control component. Axial movement of one of the shafts accomplishes actuation of the momentary switch.

20 Claims, 17 Drawing Figures

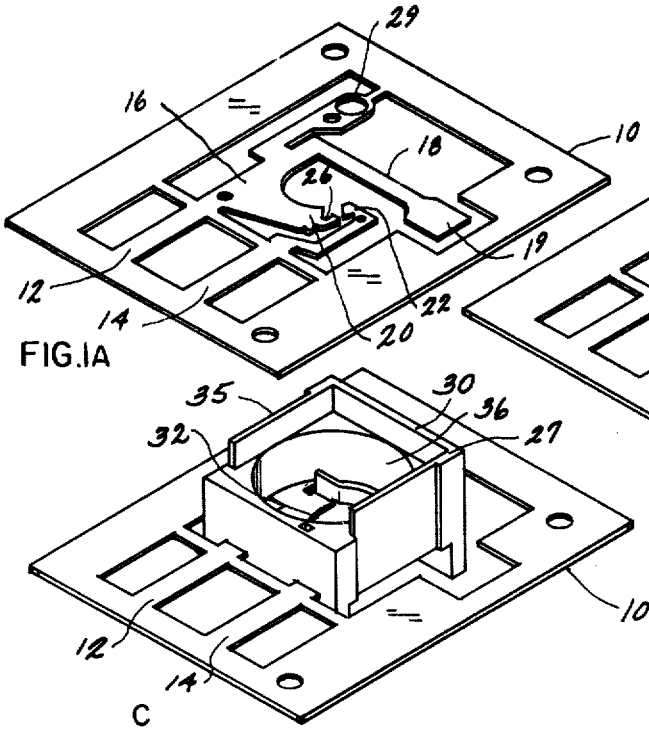
FIG.1A
FIG.1C
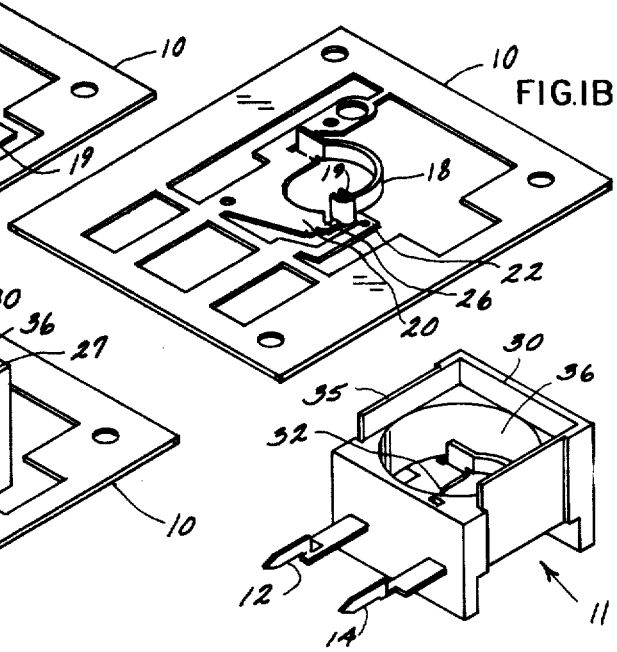
FIG.1B
FIG.1D
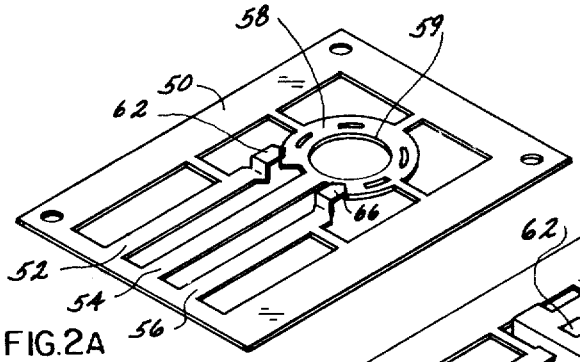
FIG.2A
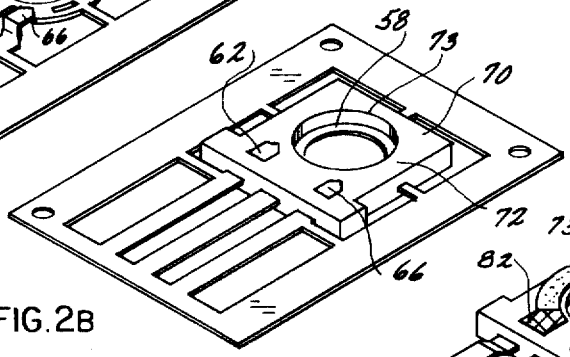
FIG.2B
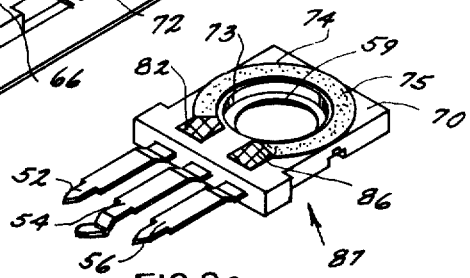
FIG.2C

TANDEM INSERT MOLDED ELECTRICAL CONTROLS AND PROCESS FOR PRODUCING SAME

BACKGROUND OF THE INVENTION

Multi-function tandem electrical controls perform a number of functions in relation to such applications as automotive radios. Components of the controls are arranged in linear alignment and are mounted in the radios for performing functions each as volume control, on-off switch control, tone control, AM-FM switching, and actuation of a retractable antenna. The prior art has numerous examples of tandem electrical controls, beginning with devices such as that described in U.S. Pat. No. 2,811,594, entitled "Switch," by F. Papouschek, and issued on Oct. 29, 1957. However, such controls require a multiplicity of parts and numerous steps for assembling the large number of parts. It is advantageous to devise a series of controls arranged in a tandem alignment comprised of controls that are easily assembled, manufactured, and consisting of a minimum number of components which perform a multiplicity of electrical functions. U.S. Pat. No. 4,096,365, issued on June 20, 1978, and entitled "Rotary Wafer Switch", illustrates a rotary wafer switch in which an open switch housing is resilient and insulating so that wafers may be snap fitted into it thereby constructing a single shaft multiple-function switch. However, such a construction again requires a multiplicity of parts, is limited as to the particular type of functions it can perform, and the components are subject to fouling from outside contaminants. U.S. Pat. No. 3,906,179 entitled, "Electrical Switch and Combination Electrical Resistor and Switch", and owned by the same assignee, describes a combination switch-variable resistor control with each of the two electrical components assembled from many seprately formed parts. Additionally, the construction of the control does not lend itself to a versatility of assembly such that distinct controls can be aligned in different order of alignment. U.S. Pat. No. 3,747,043, entitled "Tandem Electrical Control" and owned by the same assignee, describes a tandem electric control with components having individual parts consisting of resistance elements, bases, terminals, collectors, center taps, housings, shafts journaled in a bushing, and coupling straps for holding the housing sections together. In addition to having a multiplicity of parts and assembly steps, such a construction could result in a binding of the shafts when the housings sustain an impact and a possible release of the housing sections. Therefore, it is desirable to produce a tandem electrical control which comprises a minimum number of parts, is economically manufactured, has an improved impact system, a unique operating system, and which has several electrical control components that are interchangeable in order of disposition.

SUMMARY OF THE INVENTION

It is an object of the present invention to provide a tandem electrical control comprised of a minimum number of components or parts and which is economically manufactured.

It is another object of the present invention to provide an economical tandem electrical control comprising a variable resistance control, a power control, and a momentary switch control, all of the controls being contained in insert molded housings.

Another object of the present invention is to provide a tandem electrical control comprised of a plurality of electrical control components which are easily interchangeable in order of axial disposition, and which are operable by relatively movable shafts which are individually rotated and one longitudinally displaced.

Yet still another object of the present invention is to provide a tandem electrical control capable of producing a multiplicity of electrical functions and being retained within a novel impact system which withstands normal and expected external shock loads.

It is yet a further object of the present invention to provide a plurality of electrical controls, each individually contained within an insert molded housing and the housings mounted in axially aligned relationship, the aligned relationship being maintained by an impact system which absorbs any external impact upon the aligned controls and also which serves to mount the electrical controls.

The objects of the present invention are provided by a novel tandem electrical control comprising control components that may be manufactured in a highly economical manner and with a minimum number of parts involved, thereby reducing the assembly steps and the costs therein. Each of the controls, a power switch, a variable resistance control, and a momentary switch, are contained within an insert molded housing or base which are mounted one against the other in a linearly aligned relationship. The linearly aligned relationship is maintained by a novel impact system consisting of a metallic front plate having side straps with end fingers formed over to mechanically clinch with complimentary edges of a heat-treated back plate, the controls being contained within the area bounded by the front plate, side straps, and back plate. A common shaft or shafts serve to operate a plurality of the electrical control components, the shafts having an annular rotor mounted on an end thereof, the rotor containing a cam lobe on one face and on the oppositely disposed face resiliently bent collector arms and a resilient arm. Normal operation of each of the shafts effects independent actuation of the associated power switch and rotary movement of the collector arms and the resilient arms which wipably engage a collector and a resistance film, respectively, of the associated variable resistance control component. Axial movement of one of the shafts accomplishes actuation of the momentary switch.

DRAWINGS

FIG. 1 illustrates the steps of manufacturing the power control component in which FIG. 1A shows a stamped or blanked metal strip; FIG. 1B is the blanked metal strip after the resilient movable contact arm has been formed; FIG. 1C shows the insert molded housing formed about the parts of the power control component; FIG. 1D is the power control component after trimming from the metal strip;

FIG. 2 illustrates the steps of manufacturing the variable resistance control component in which FIG. 2A shows the metal strip after the collector and terminals are formed by stamping or blanking; FIG. 2B is the blanked metal strip after insert molding of the base; FIG. 2C illustrates the variable resistance control base after a resistance film has been disposed thereon and trimming from the metal strip completed;

FIG. 3 illustrates the steps of manufacturing the momentary switch control in which FIG. 3A is the blanked metal strip; FIG. 3B shows the metal strip after forming which offsets the resilient switch arm bridge and terminal ends; FIG. 3C is a section view of the formed metal strip shown in FIG. 3B; FIG. 3D shows the formed metal strip after insert molding of the housing; FIG. 3E is the momentary switch housing after trimming from the metal strip;

DETAILED DESCRIPTION OF THE INVENTION

Figure 3A:
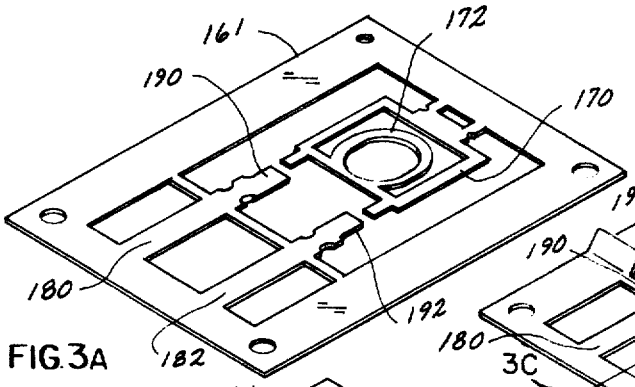

Referring now to the drawings, FIG. 1 illustrates the steps of manufacturing the electrical power control designated generally by numeral 11. FIG. 1A shows part of a continuous metal strip 10 having been blanked or stamped to form the terminals, resilient movable contact arm, and stationary contact points for the power switch. The terminals 12, 14 each depend from central plate 16, as does the resilient movable contact arm 18 and terminal ear 29. The stationary contacts are "off" contact 20 and "on" contact 22. The metal strip 10 proceeds through successively progressive forming steps until the resilient movable switch arm 18 and movable contact 19 are completely formed as shown in FIG. 1B. In FIG. 1B, resilient movable contact 19 abuts against stationary "on" contact 22, and when in the off position, will be received in the notch 26 of the stationary "off" contact 20. The resilient movable contact arm 18 is biased by a cam lobe, as will hereinafter be described. In the next step of production, power control housing 27 is formed about the terminals 12, 14 and the resilient movable contact arm 18 as shown in FIG. 1C, and extending from the top of the housing 27 is terminal ear 29 which serves as an external power input if the power input is not received through terminal 12. The housing 27 is made of an insulative material such as polyphrenylene sulfide resin, and is heat resistant and durable. The housing 27 is generally box-like in configuration, having an open end 30 and an oppositely disposed aperture 32 coaxial with the resilient movable switch arm 18. The final manufacturing step in producing this portion of the power control is the cutting away of the metal strip 10 and forming the bottoms of terminals 12 and 14 by bending them forwardly. The front of the housing 27 provides an overhang 35 suitable for receiving a base or cover for enclosing the housing and also mounting a fixed resistor in relation thereto. Thus, the components of the power control i.e., the terminals, stationary contacts, and the resilient movable contact arm, have been formed with a minimal number of parts by stamping and forming of a metal sheet and then insert molding a housing thereabout. The housing 27 contains cavity 36 which serves to receive a shaft and a generally annular rotor which will actuate the on-off function of the power control 11 by effecting the respective movements of the movable resilient control arm 18, as will be described hereinafter.

Co-pending and commonly assigned Application Ser. No. 988,166 entitled "Variable Resistance Control and Method of Making Same," filed Apr. 24, 1978, describes a variable element deposited onto the body and onto portions of the terminals. The variable resistance control component described herein and designated generally by reference numeral 87 in FIG. 2C, is formed in generally the same manner as in copending Application Ser. No. 899,166 which is incorporated by reference herein. As shown in FIG. 2, a continuous sheet metal strip 50 is blanked or stamped to form terminals 52, 54, and 56, a collector plate 58 integral with terminal 54, a collector plate aperture 59, and terminal tabs 62 and 66 formed such that the tabs are disposed in a plane above the plane of the sheet metal strip 50. Next, the metal strip 50 has a body 70 formed onto and about the terminals and collector plate by insert molding, as shown in FIG. 2B. Terminal tabs 62 and 66 are flush with the top surface 72 of the body 70 while collector plate 58 is disposed within a central aperture 73. The body 70 consists of a resin material, such as polyphrenylene sulfide resin, and encases the centrally disposed collector plate 58 while providing an aperture 73 for a shaft to pass therethrough and a contactor to reach therein. Next, an arcuate resistance film 74 is screened onto the body 70 such that ends 82 and 86 of the arcuate resistance film 74 overlap the terminal tabs 62 and 66, respectively. The resistance film is cured to produce a resistance element 75, and then the strip 50 proceeds through a further forming and trimming operation.

The variable resistor component 87 is trimmed from the circumposing metal strip 50 and the terminals 52, 54, and 56 are formed for insertion into a printed circuit board. Additionally, the end of terminal 54 may be bent in a stepped manner to provide for a resilient snap-in mounting of the resistance component. Body 70 is of a generally rectangular shape and is mountable within the overhang 35 of housing 27. The body 70 is mounted in the housing 27 so that the resistance element 75 faces inwardly of the housing 27, that is towards the resiliently movable contact arm 18. Thus, the variable resistance control component 87 has been made simply by blanking and forming the metal parts, molding a body onto and about the metal parts, screening and curing a resistance film on the body, and trimming the component 87 from the metal strip 50.

The variable resistance control component 87 comprising the body 70 and depending terminals 52, 54, and 56, as shown in FIG. 2C, is a unitary embodiment which can be easily mounted within the overhang flange 35 of housing 27. The assembly of the body 70 and housing 27 encloses the variable resistance component and power control component within a closed encasement. Prior to the mounting of body 70 in overhang 35 of housing 27, a longitudinal drive shaft having an annular rotar mounted thereon is mounted in the housing 27 for actuation of the power control component 11 and variable resistance control component 87, as will be described.

Referring now to FIGS. 4–7, a metal drive shaft 90 is formed by cold drawing a steel rod. End 92 is of a reduced diameter and has a flat plateau 94 for key insertion into a control knob (not shown). End 96 of drive shaft 90 has reduced diameter portions 98, 100, and 102. Portion 100 of drive shaft 90 serves as a mount for an annular rotor 110 and reduced diameter portion 102 is journaled in an aperture 275 of a heat-treated back plate 270, and reduced diameter portion 98 has mounted thereon a T-shaped annular actuator 205, to be described hereinafter.

The annular rotor 110 is mounted upon portion 100 of drive shaft 90 and has on one surface an axially extending cam lobe 112 disposed at the radial periphery of the annular rotor. The cam lobe 112 serves as a cam which displaces the resilient movable contact 19 of the power switch from one stationary contact to another stationary contact, thereby making or breaking the electrical circuit output of the power control component 11, depending on the direction of rotation of the drive shaft 90. When the resilient movable contact 19 is in the "on" position, that is the contact 19 is disposed between and in abutting relationship with both stationary contacts 20 and 22, rotation of shaft 90 in a counterclockwise direction relative to the metal strip of FIG. 1C, brings the lobe 112 into contact with the movable contact 19. The lobe 112 displaces the contact 19 inwardly and downwardly into contact with the stationary contact 20, the contact 19 resting in the notch 26 of contact 20, the lobe disposed in abutting relationship with the contact 19. Clockwise rotation of the shaft 90 will effect the reverse of the above-described movement so that the contact 19 is again located between and abutting the stationary contacts 20 and 22, thereby making an electrical circuit across the terminals 12, 14. When assembled, the drive shaft 90 and annular rotor 110 are positioned within the housing 27 so that the cam lobe 112 may contact the movable contact 19 while a resilient contactor 116 mounted on the opposite surface 111 of the annular rotor 110 is in facing relationship with the resistance element 75 of the body 70 mounted within the overhang 35. The resilient contactor 116 comprises a resilient arm 118 terminating in a plurality of flexible fingers 120, and a pair of oppositely-disposed, resiliently-bent collector arms 124 and 126, the resilient contactor 116 being mounted on the annular rotor 110 by heat staking methods well known in the art. Both the resilient arm 118 and resilient collector arms 124 and 126 are formed to extend axially outwardly from the surface 111 of the annular rotor, and when the annular rotor is mounted in confronting relationship with the body 70 and resistance element 75, the flexible fingers 120 are biased into contact with the resistance element 75 and the collector arms 124, 126 are biased into contact with the collector plate 58. As the drive shaft 90 is rotated, the collector arms 124 and 126 wipably engage the collector plate 58 and the flexible fingers 120 of the resilient arm 118 wipably engage the element 75 to effect a variable electrical output across terminals 52 and 56.

Figure 5:
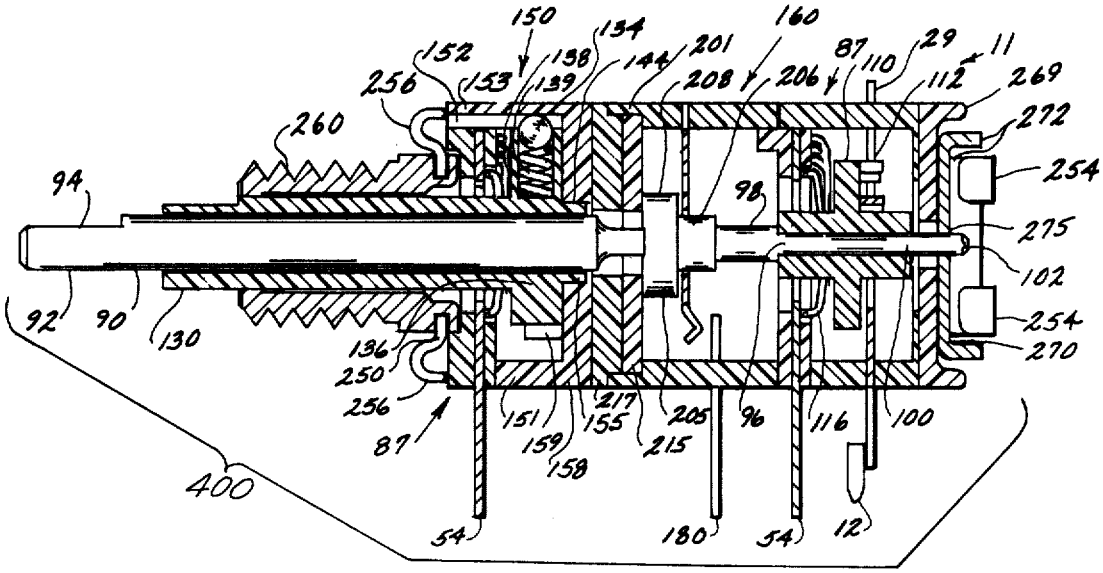
FIG. 5 is a section view taken along view line 5—5 of the four-function tandem control shown in FIG. 4.
Figure 5A:
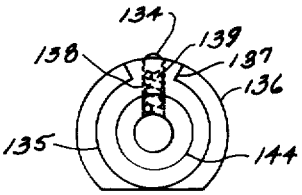
FIG. 5A is an end view of an annular rotor integral with a concentric annular shaft.

Metal drive shaft 90 may be journaled within a concentric insulative shaft 130 when a second variable resistance control component 87 is contained with the tandem electrical control, the concentric insulative shaft 130 providing independent control of the second variable resistance control component. Concentric insulative shaft 130 consists of an insulative material such as nylon and has axial opening 133 passing throughout the length of the shaft. At end 135 is an integral annular rotor 136 having on one face thereof a radially spaced dove-tail cam lobe 137 as shown in FIG. 5A, and on the opposite face is mounted, by heat staking, the resilient contactor 116. A radial shaft 138 in rotor 136 houses a spring 139 which biases a detent ball 134 radially outwardly to be received in an axially entending groove. The small diameter end 144 of the insulative concentric shaft may be journaled in an aperture 155 of a concentric housing 150 as shown in FIG. 5. Concentric housing 150 is similar to housing 27 but no terminals or power switch parts are contained therein. Concentric housing 150 has an open end 151 having an overhang 153, with axial groove 152 disposed along the top of the interior of the housing. As with housing 27, the variable resistance body 70 is then mounted within the overhang 153, the insulative concentric shaft 130 extending therethrough. The dove-tail cam lobe 137 of the annular rotor 136 limits rotational movement of the shaft 130 by engagement with stop abutments 159 located within the rotor section 158 of the housing 150, the flexible fingers 120 of the contactor 116 biasly engage the resistance element 75, and the collector arms 124, 126 biasly engage the collector plate 58. Rotation of the concentric insulative shaft 130 moves the flexible fingers 120 of the contactor 116 along the resistance element 75 thereby effecting a variable electrical output, and when the detent ball 134 moves into the groove 152, the detent provides a positioning reference for the control user. If the concentric insulative shaft 130 is utilized with the combination of a variable resistance control component 87 and a power control component 11 as shown in FIG. 6, then the cam lobe on the annular rotor 136 would be identical to the cam lobe 112, and the rotor 136 would be disposed within an insert molded housing 27 to effect power control operation therein.

Another electrical control component which may be included within the tandem electrical control is a momentary switch. The momentary switch component designated generally by reference numeral 160 in FIG. 3E, is manufactured by generally the same steps as described in the manufacture of the power control component and variable resistor control component.

Figure 3B:
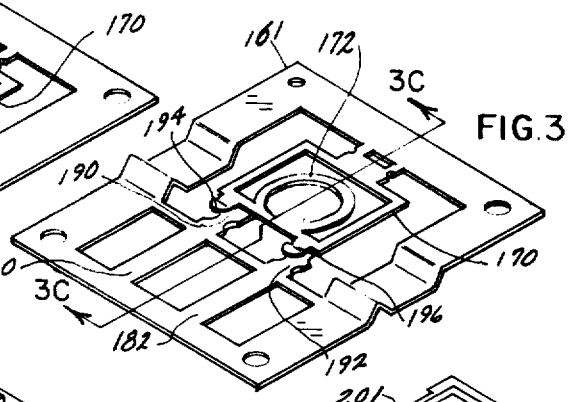
Figure 3D:
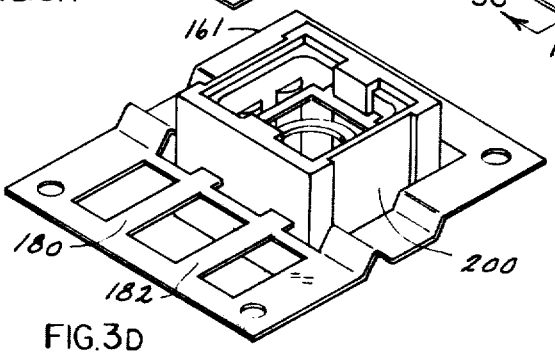
Figure 3E:
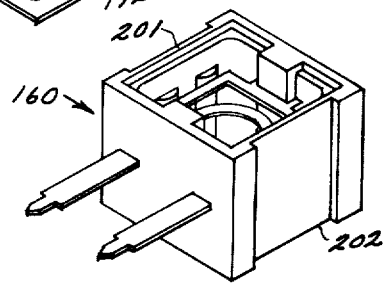
Figure 3C:
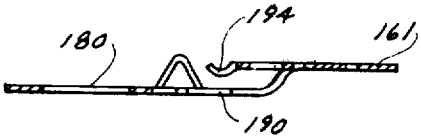

Referring to FIG. 3A, there is shown a continuous metal strip 161 which has been blanked or stamped to form a resilient momentary switch arm 170 and terminals 180, 182, and terminal ends 190, 192. In FIG. 3B, the metal strip 161 and switch arm 170 have been formed so that terminal ends 190, 192 are situated opposite and below switch arm contacts 194, 196, respectively, as shown in more detail in FIG. 3C. A momentary switch housing 200 is formed about the momentary switch arm 170, terminal contacts 190, 192, and switch arms contacts 194, 196, by insert molding, FIG. 3D. The switch housing 200 and terminals 180, 182 are then trimmed away from the metal strip 161, with the terminals trimmed as shown in FIG. 3E. The T-shaped annular actuator 205 having a flange 208 and mounted upon the reduced diameter portion 98 of shaft 90, is positioned within the momentary switch housing 200 such that the flange 208 abuttingly engages on one side the annular ring 172 of switch arm 170 and on the other side the insulator plate 215 (see FIGS. 5 and 7). The insulator plate 215 is received in housing end 201 and provides a bearing surface for the flange 208, and in combination with housing plate 217, retains the drive shaft 90 and T-shaped annular actuator 205 within the momentary switch housing 200, thereby preventing the drive shaft 90 from being pulled out of the tandem electrical control. The drive shaft 90 passes through opening 216 in insulator plate 215 and opening 219 in plate 217, and end 96 passes through housing end 202. The actuator shaft 206 is received in the annular ring 172. Because the actuator 205 consists of an insulative material, the metal drive shaft 90 is insulated from electrical contact with the momentary switch arm 170. As the metal drive shaft 90 is moved axially, the actuator 205 biases the momentary switch arm 170 so that the switch arm contacts 194, 196 make contact with terminals 190, 192, respectively, completing an electrical circuit across terminals 180 and 182. The resiliency of the momentary switch arm 170 is such that when the axial force is released from the metal drive shaft, the momentary switch arm 170 resiliently restores the actuator and drive shaft to the initial position thereby disengaging the contacts from the terminal ends and opening the electrical circuit.

Figure 6:
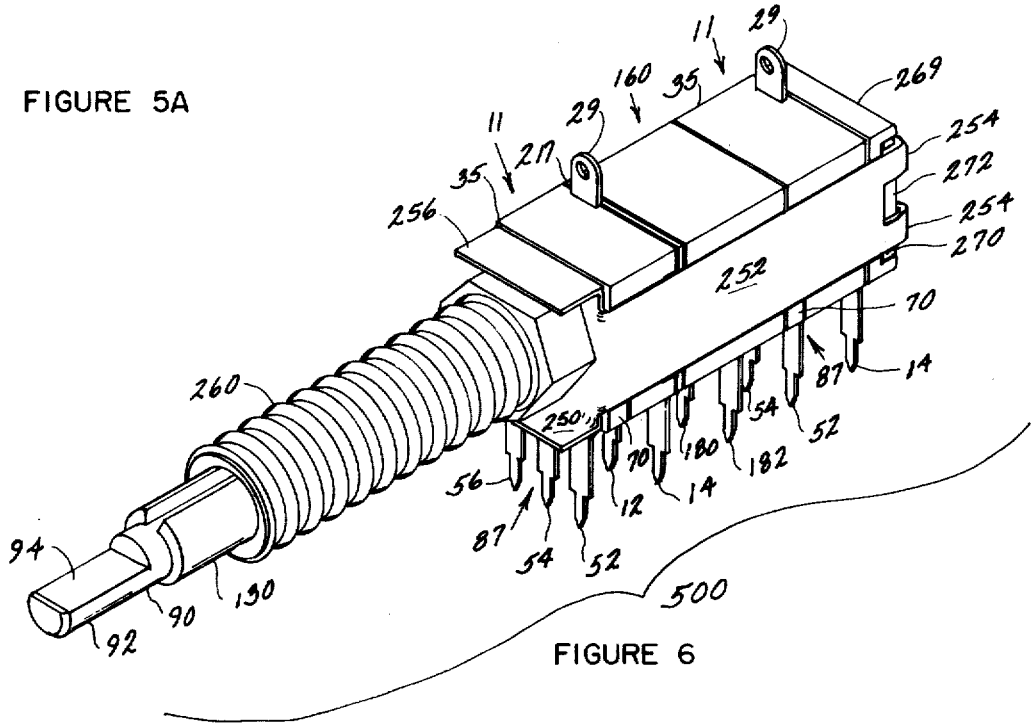
FIG. 6 is an isometric view of a five-function tandem electrical control unit; and, FIG. 7 is an exploded isometric view of the tandem electrical control unit of FIG. 6.
Figure 7:
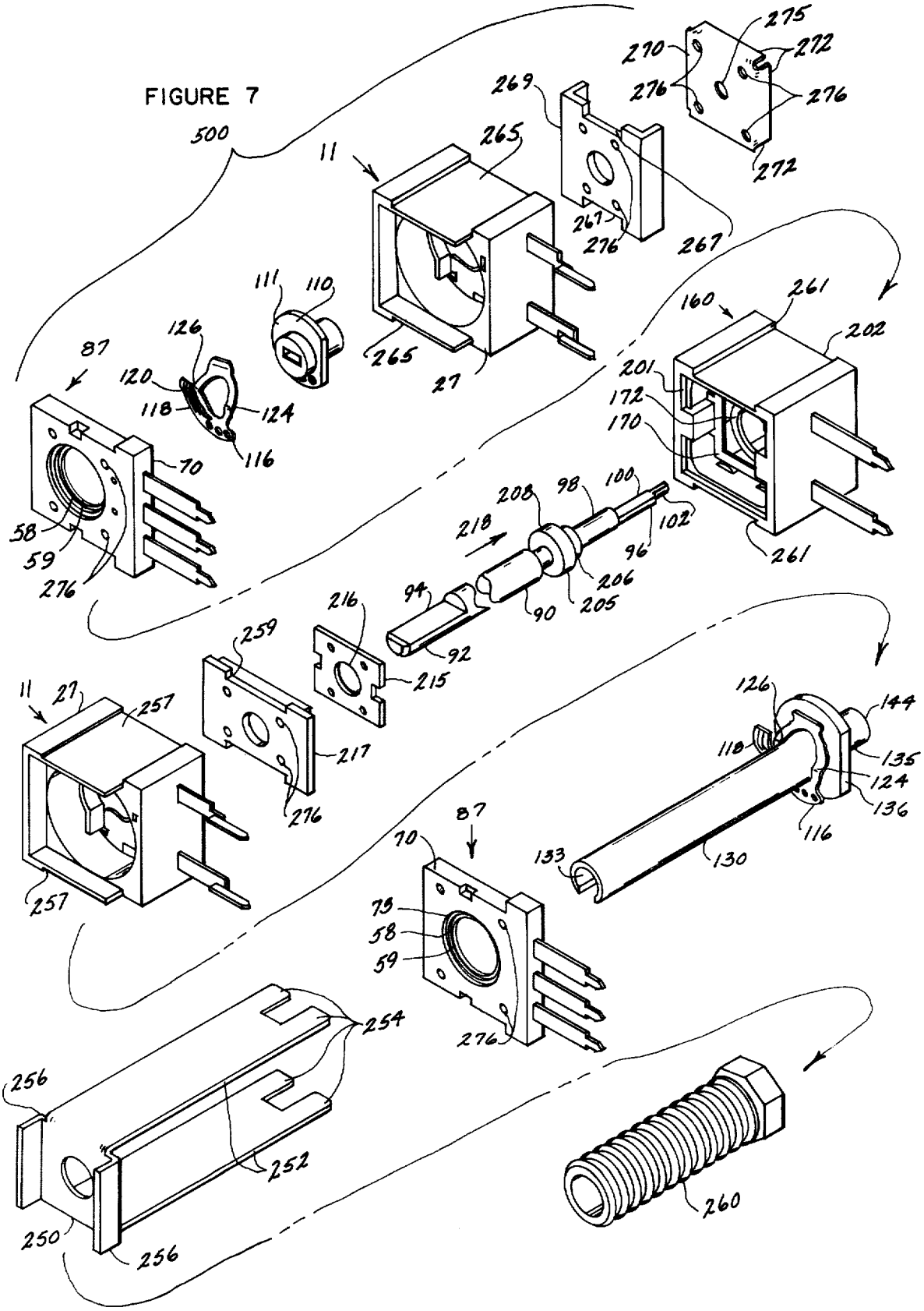

Referring now to FIGS. 4–7, there is illustrated therein the impact assembly within which the electrical control components are captured, maintained in alignment, and commonly operated by the metal drive shaft and concentric insulative shaft. Front plate 250 has side straps 252, each side strap having a set of end fingers 254, and front plate 250 has formed sides 256. In FIG. 7, the sides 252 are proportioned to fit within the aligned notches 257 of housing 27, notches 259 of housing plate 217, notches 261 of momentary switch housing 200, notches 265 in the rear housing 27, and notches 267 in adapter 269 before clinching the fingers 254 to capture the components as shown in FIG. 6. It is an important feature of this invention that the sides 256 be curled over so that when the tandem electrical control experiences an impact force which is transmitted to the front plate 250, the formed sides 256 prevent the front plate from buckling. Mounted on the front plate 250 is a threaded concentric housing 260 in which is journaled the concentric insulative shaft 130. The bushing 260 is threaded to facilitate mounting of the tandem electrical control on a panel. Back plate 270 is of a generally rectangular configuration and is mounted in abutting and nested relationship with the adapter 269. Side flanges 272 extend outwardly from the back plate 270 to provide walls over which the end fingers 254 may be bent in order to secure the back plate to the side straps 252. Disposed in the center of back plate 270 is aperture 275 which receives the reduced diameter portion 102 of the metal drive shaft 90. The reduced diameter portion is journaled within the aperture 275, and the corner apertures 276 are in alignment with positioning projections (Not Shown) projecting from the back of the adapter 269 thereby effecting proper alignment of the back plate. In some embodiments of the tandem electrical control, the adapter 269 is eliminated and a power control housing 27 has flanges extending from the back of the housing for positioning of the back plate 270. The power control housing 27, concentric housing 150, and momentary switch housing 200 each having positioning projections on the back thereof, and which are received by corner apertures 276 in the respective body 70, housing plate 217, and adapter 269 (See FIG. 7) for aligning the components. It is an important feature of this invention that the back plate 270 be heat-treated because when the metal drive shaft 90 is impacted axially towards the rear of the tandem electrical control (in the direction of arrow 218 in FIG. 7) the forces acting upon the rear plate are concentrated in the area of aperture 275 such that the back plate would warp if not strengthened by heat-treating. This is particularly true if the tandem electrical control experiences a severe impact which is transmitted through the metal drive shaft 90 directly to the rear plate and the area circumposing the aperture 275. It is also an important feature of this invention that the fingers 254 not merely be bent over the flanges 272, but that they be curled over the flanges so that the tips of the fingers are reversely bent approximately 180°. If the fingers 254 are not reversely bent, a severe impact force which is transmitted from the back plate to the side straps 252 would cause the fingers 254 to be bent outwardly and release the back plate. It has been found that reversely bending the end fingers 254 such that they are curled over the flanges 272 prevents the fingers from bending open and significantly improves the impact resistance of the tandem electrical control unit. Impact forces on the control knob mounted upon the drive shaft 90 are transmitted to the heat-treated rear plate, to the side straps, and then to the front plate and threaded concentric bushing which secures the control to a panel board, the forces being absorbed by the panel board.

OPERATION

Figure 4:
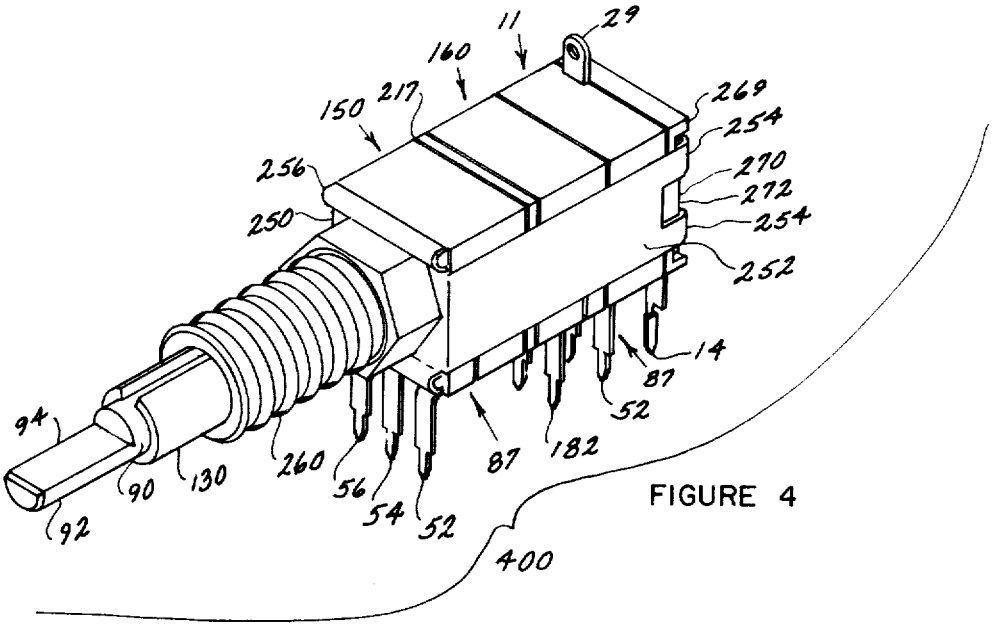
FIG. 4 is an isometric view of a four-function tandem electrical control unit.

Referring now to FIGS. 4 and 5, there is shown an isometric view and section view, respectively, of a four-function tandem electrical control unit 400 comprising a pair of variable resistance control components 87, a power control component 11, and a momentary switch component 160. The impact assembly is comprised of the threaded concentric bushing 260, front plate 250, side straps 252, fingers 254, and back plate 270. First, a variable resistance control component 87 is placed between the straps 252, the back of body 70 abutting the rear or back surface of the front plate 250. Concentric insulative shaft 130 having resilient conductor 116 mounted on the annular rotor 136 is then inserted through the aperture 73 and collector plate aperture 59 in the variable resistance control component, and journaled in the bushing 260, the shaft of the concentric insulative shaft extending axially beyond the end of the threaded bushing for mounting of a control knob thereon. Once inserted, the concentric insulative shaft biases the flexible fingers 120 into engagement with the facing resistance element 75 and the collector arms 124, 126 into engagement with the collector plate 58. The concentric housing 150 is then inserted and positioned between the straps 252 with the overhang 153 receiving the body 70, thereby enclosing the annular rotor 136 and resilient contactor 116 within the concentric housing and journaling the small diameter end 144 in housing aperture 155. The housing plate 217 and insulator plate 215 are mounted against the rear of the concentric housing 150. Metal drive shaft 90 having the actuator 205 mounted thereon is inserted into the opening 133 of shaft 130 until the flange 208 abuts the insulator plate 215.

Momentary switch housing 200 is placed between the side straps and fitted over the plates 215 and 217, with shaft 90 extending out the back of the housing and the actuator shaft 206 received in the annular ring 172. Another variable resistance control component 87 is positioned against the back of the momentary switch housing 200, with diameter portion 98 of shaft 90 passing through the apertures 73 and 59. Next, an annular rotor 110 having a resilient contactor 116 secured thereon is mounted on the reduced diameter portion 100, which biases the flexible flanges 120 into engagement with the resistance element 75 and the collector arms 124, 126 into engagement with the collector plate 58. Housing 27 is then inserted between the straps 252 such that the overhang 35 circumposes three sides of the body 70 and encloses the annular rotor 110 within the housing. Adapter 269 and back plate 270 are mounted behind housing 27 and the reduced diameter portion 102 of the drive shaft 90 journaled within the aperture 275. Then the end fingers 254 are reversely bent or curled over the flanges 272 of the heat-treated back plate 270 thereby completing the mounting of each of the various electrical control components within the front plate 250, side straps 252, and back plate 270. The electrical control components are in linear alignment and may be operated by the respective shafts 90 and 130. Clockwise rotation of the metal drive shaft 90 rotates the cam lobe 112 and displaces the movable contact 19 to effect an electrical circuit across the two depending terminals 12 and 14. Further rotation of the metal drive shaft 90 advances the flexible fingers 120 along the resistance element 75 of the rear variable resistance control component 87, thereby effecting a variable electrical output across terminals 52, 56. Likewise, rotation of the concentric insulative shaft 130 effects advancement of the flexible fingers 120 along the resistance element 75 disposed on the body 70 of the front variable resistance control component 87 to effect a variable electrical output from the component with the detent ball 134 and groove 151 providing positioning reference for the control user. The metal drive shaft 90 and concentric insulative shaft 130 may be operated independently, and thus the respective variable resistance control components may be operated independently. Axial movement of the drive shaft 90 toward the rear of the control 400 effects actuation of the momentary switch component 160, the resiliency of the momentary switch arm 170 returning the shaft to its original position when the force upon the shaft is removed.

It should be understood that a variable resistance control component can be mounted within the overhang of either a power control housing 27 or a concentric housing 150, whereby the annular rotor 110 or 136 of the respective shaft (metal shaft 90 or consentric insulative shaft 130) can effect either operation of both the power control component and the variable resistance control component, or operation of just the variable resistance control component when a concentric housing is mounted thereabout. Subject to the mounting of the variable resistance control component 87 within the overhang of a concentric housing 150 or a power control housing 27, the electrical control components may be arranged in whichever order is desired and any number of components may be included within a tandem electrical control. Minor design modifications would allow all the components to be relatively disposed in any linear order desired. It is an important feature of this invention that according to customer specification, the tandem electrical control can contain one or more of each of the electrical control components, linearly aligned in which ever order may be desired. This versatility of positioning of the respective control components is highly desirable and is made possible by the simplified manufacturing process which produces each component having a molded housing or body which can be positioned in aligned relationship with the other control components. It can readily be seen that the number of components and the variation of alignment are almost limitless according to the number of components contained within the tandem electrical control.

Another embodiment of the invention illustrates the use of all three electrical components within the tandem electrical control unit and again illustrates the mounting of more than one of a particular type of electrical control component. Referring to FIGS. 6 and 7, there is illustrated an isometric view and an isometric exploded view of a five-function tandem electrical control unit 500 comprising a pair of variable resistance control components 87, a pair of power control components 11, and momentary switch component 160. The tandem electrical control unit 500 is constructed in the same steps as described above. A variable resistance control component 87 is first mounted in abutting relationship with the back of the front plate 250, then a concentric insulative shaft 130 is inserted through the central aperture 73 in the body 70 and journaled in the threaded concentric bushing 260, the resilient contactor 116 mounted on the annular rotor 136 biased into engagement with the resistance element 75 and collector plate 58. In this embodiment, the rotor 136 does not have a detent mechanism as illustrated in FIG. 5. Because a power control housing 27 instead of a concentric housing 150 is to be mounted about the first variable resistance control component 87, the annular rotor 136 has a cam lobe 112 rather than a dove-tail cam lobe 137. The power housing 27 is inserted between the straps 252 and positioned so that the overhang 35 encompasses the body 70 and captures the annular rotor of the concentric insulative shaft therein. The remainder of the electrical control components are the same as illustrated in FIGS. 4 and 5 and are assembled as previously described and for that reason the remainder of the assembly steps will not be described. The five-function tandem electrical control 500 will perform the following functions: As the concentric insulative shaft 130 is rotated by a knob (Not Shown) mounted theron, the flexible fingers 120 of the resilient contactor 116 wipably engage the resistance element 75 of the first or front component 87 as the collector arms 124, 126 wipably engage the collector plate 58 to effect a variable electrical output. Likewise, initial clockwise rotation of the concentric insulative shaft 130 effects movement of the resilient movable contact 19 in power housing 27 to open or close the circuit across the terminals 12, 14. Rotation of the metal drive shaft 90 effects the same electrical functions and control of the second or rear mounted variable resistance control component 87 and associated power control component 11. Additionally, axial movement of the metal drive shaft 90 in the direction of arrow 218 towards the rear of the tandem electrical control unit 500 will effect actuation of the momentary switch component 160 when the actuator 205 biases the arm contacts 194, 196 into engagement with terminal ends 190, 192, respectively, thereby completing a circuit across the terminals 180, 182. Thus, the tandem electrical control unit 500 can perform the five electrical functions in a very simple manner. A tandem electrical control constructed in the aforedescribed manner is a highly economical, easily manufactured control which can be produced in great quantities. Moreover, the various electrical control components of the unit can be added and removed from the unit and arranged in various orders of alignment according to customer specifications.

CONCLUSION

Although the present invention has been illustrated and described in connection with two example embodiments, it will be understood that this is illustrative of the invention, and it is by no means restrictive thereof. It is reasonably to be expected that those skilled in the art can make numerous revisions and additions of the invention and it is intended that such revisions and additions will be included within the scope of the following claims as equivalents to the invention.

What is claimed as new and desired to be secured by Letters Patent of the United States is:

1. A process for performing multiple electrical control functions, comprising the steps of aligning linearly at least three insert molded electrical control means within an impact construction, said construction comprising a front plate having side straps extending the cumulative length of said control means to encompass them longitudinally and disposed exteriorly of said control means, each of said straps including finger ends, and a rear plate, mechanically securing the finger ends to the rear plate positioned against the endmost one of said aligned control means, said control means comprising a variable resistance control, a power control, and a momentary switch, each of which is insert molded and relatively changeable in their relative alignment within said construction, a hollow concentric insulator shaft for operation of said controls, and a longitudinal metallic shaft journaled within said concentric insulator shaft, and rotating the longitudinal metallic shaft which extends through the respective control means.

2. The process in accordance with claim 1, in which flanges extend from the rear plate and the securing step consists of curling finger ends over the flanges.

3. The process in accordance with claim 1, including the steps of heat treating the rear plate and curling over at least one side of the front plate, whereby the impact resistance of the plates is increased.

4. The process in accordance with claim 1, including the step of securing a bushing to said front plate and journaling said concentric insulative shaft therein.

5. The process in accordance with claim 1, including the step of defining a rotational position of said insulative shaft by radially biasing a detent ball for reception by a complementary groove disposed within a control means.

6. A process for performing multiple electrical control functions, comprising the steps of aligning a plurality of inserted molded electrical control components and capturing and maintaining said components within an impact assembly, said impact assembly comprising a front plate having side straps extending the cumulative length of said control components and each strap having end fingers, a back plate having an aperture, the plurality of electrical control components comprising at least one each of an electrical power control and a variable resistance control, said electrical control components being linearly aligned between said side straps which extend along side of and in contact with said components and the back plate disposed in abuttable engagement with the confronting rear electrical control component, mechanically curling the end fingers over to secure the back plate against said confronting rear electrical control component, and rotating a longitudinal drive shaft which extends through aligned openings in said components in order to actuate said electrical control components, said shaft having one end journaled in the aperture in said back plate.

7. The process in accordance with claim 6, including the steps of securing a threaded bushing to said front plate and journaling said drive shaft therein.

8. The process in accordance with claim 6, including the step of forming side flanges on said rear plate for mechanically curling said end fingers over said side flanges.

9. The process in accordance with claim 6, including the step of heat-treating said back plate.

10. The process in accordance with claim 6, including the step of curling over at least one end of said front plate, thereby increasing the impact resistance of said front plate.

11. The process in accordance with claim 6, including the steps of securing a bushing to said front plate and journaling a concentric insulative shaft within said bushing and journaling said longitudinal drive shaft within said insulative shaft, rotation of the concentric shaft effecting operation of at least one of said electrical control components.

12. The process in accordance with claim 11, including the step of defining a rotational position of said insulative shaft, an annular rotor being disposed about an end of said concentric shaft and containing a radial opening having a resilient means therein, biasing a detent ball radially outward and an electrical control component housing having a groove therein, said detent ball being receivable in said groove.

13. The process in accordance with claim 6, wherein said components include at least one momentary switch control.

14. A tandem electrical control comprising at least one component consisting of a power switch and at least one component providing a selectively controllable variable resistance, capturing means having side members disposed exteriorly of said components and with each side member extending along opposite faces of said components, said side members including integral elongated portions extending the cumulative length of the combined components and effecting a mechanical connection between said side members whereby the electrical components are effectively contained within an envelope provided by said side members, actuating means extending between said side members and interiorly of said components through aligned openings therein whereby said components are selectively actuated one with respect to the other, and means forming a hardened bearing surface confronting the endmost one of said components and disposed between said side members whereby longitudinal impact forces are communicable through said side members without producing destructive deformation of said components.

15. The control in accordance with claim 14, further comprising a momentary switch component, whereby said momentary switch component is operable by said actuating means independently of the other electrical components.

16. The control in accordance with claim 15, wherein said actuator means comprises two coaxial shaft means providing independent rotational and axial movement relatively and independently to each other.

17. The control in accordance with claim 14, wherein said means forming a hardened bearing surface includes flanges and said elongated portions include end fingers, said fingers curled over said flanges.

18. The control in accordance with claim 14, wherein said capturing means includes a front plate having at least one end curled over.

19. The control in accordance with claim 14, further comprising a threaded bushing secured to said capturing means and said actuating means being journaled therein.

20. A process for producing a control having multiple components therein, comprising the steps of: insert molding each of the respective components within a substantially standard exteriorly sized block of insert molded plastic material whereby such components may be assembled in a preferred longitudinal order, inserting a control means extending through registered openings in respective ones of said blocks, capturing the so assembled components to retain them in a rigid permanent assembled relationship by confronting one of the endmost blocks with a first plate, confining the lateral sides of the blocks with two spaced-apart metallic side arms which extend the cumulative dimension of said blocks, thereafter mechanically clenching a deformable extended section of each of said side members to effect an endwise clamping securement with a second plate confronting the other of the endmost blocks whereby the components are held in permanent stacked end-to-end relationship and longitudinally directed impact forces through said control means are sustained through said second plate confronting the other endmost electrical component and thereafter communicated through said side members and independently of said electrical components.

* * * * *